US009957100B2

(12) United States Patent
Jasper et al.

(10) Patent No.: US 9,957,100 B2
(45) Date of Patent: May 1, 2018

(54) DISPENSING DEVICE

(71) Applicant: APTAR DORTMUND GMBH, Dortmund (DE)

(72) Inventors: Bernd Jasper, Waltrop (DE); Ralf Jordan, Dortmund (DE)

(73) Assignee: APTAR DORTMUND GMBH, Dortmund (DE)

( * ) Notice: Subject to any disclaimer, the term of this patent is extended or adjusted under 35 U.S.C. 154(b) by 27 days.

(21) Appl. No.: 15/108,024

(22) PCT Filed: Nov. 15, 2014

(86) PCT No.: PCT/EP2014/003064
§ 371 (c)(1),
(2) Date: Jun. 24, 2016

(87) PCT Pub. No.: WO2015/106776
PCT Pub. Date: Jul. 23, 2015

(65) Prior Publication Data

US 2016/0325916 A1 Nov. 10, 2016

(30) Foreign Application Priority Data

Jan. 17, 2014 (DE) ..... 10 2014 000 425

(51) Int. Cl.
*B67B 1/00* (2006.01)
*B65D 83/22* (2006.01)
(Continued)

(52) U.S. Cl.
CPC ..... *B65D 83/22* (2013.01); *B05B 1/1636* (2013.01); *B65D 83/205* (2013.01); *B65D 83/28* (2013.01);
(Continued)

(58) Field of Classification Search
CPC . B67D 7/62; B67D 7/05; B67D 7/305; B65D 83/22; B65D 83/28; B65D 83/205;
(Continued)

(56) References Cited

U.S. PATENT DOCUMENTS 2,797,965 A 7/1957 McKernan
2,997,243 A 8/1961 Kolb
(Continued)

FOREIGN PATENT DOCUMENTS

DE 69416421 T2 7/1999

OTHER PUBLICATIONS

International Search Report for International Application No. PCT/EP2014/003064, dated Feb. 9, 2015.
Written Opinion for International Application No. PCT/EP2014/003064, dated Feb. 9, 2015.
International Preliminary Report on Patentability for International Application No. PCT/EP2014/003064, dated Jul. 19, 2016.

*Primary Examiner* — Lien Ngo
(74) *Attorney, Agent, or Firm* — Jason H. Vick; Sheridan Ross, PC

(57) ABSTRACT

A dispensing device having two output channels (6) for selectively dispensing a preferably liquid product is proposed. In order to switch between the output channels (6), the dispensing device has a switching part (10) that can be rotated by means of an associated actuation part (9). A simple and cost-effective design is made possible by the fact that the actuation part (9) engages axially into the switching part (10), and the switching part (10) has a peripheral seal and is self-sealing.

30 Claims, 8 Drawing Sheets

(51) Int. Cl.

| | |
|---|---|
| ***B05B 1/16*** | (2006.01) |
| ***B65D 83/20*** | (2006.01) |
| ***B65D 83/28*** | (2006.01) |
| *B05B 11/00* | (2006.01) |
| *B65D 83/34* | (2006.01) |

(52) U.S. Cl.
CPC ..... *B05B 11/3097* (2013.01); *B65D 83/345* (2013.01)

(58) Field of Classification Search
CPC .. B05B 1/1636; B05B 11/3097; B85D 83/345
USPC ... 222/402.13, 327.7, 327.8, 402.11, 402.15, 222/153.11–153.14; 239/321.7, 321.8, 239/390–392
See application file for complete search history.

(56) References Cited

U.S. PATENT DOCUMENTS

| | | | | |
|---|---|---|---|---|
| 3,180,536 | A | 4/1965 | Meshberg | |
| 3,703,994 | A | 11/1972 | Nigro | |
| 3,863,816 | A | 2/1975 | Focht | |
| 5,337,926 | A | 8/1994 | Drobish et al. | |
| 5,385,303 | A | 1/1995 | Gosselin et al. | |
| 5,411,185 | A | 5/1995 | Drobish | |
| 8,276,832 | B2 * | 10/2012 | Nelson | B05B 1/1645 222/402.13 |
| 2011/0017781 | A1 | 1/2011 | Nelson et al. | |

* cited by examiner

DISPENSING DEVICE

CROSS REFERENCE TO RELATED APPLICATIONS

This application is a national stage application under 35 U.S.C. 371 of PCT Application No. PCT/EP2014/003064 having an international filing date of 15 Nov. 2014 which designated the United States, which PCT application claimed the benefit of German Application No. 10 2014 000 425.2 filed 17 Jan. 2014, each of which are incorporated herein by reference in their entirety.

The present invention relates to a dispensing device according to the preamble of claim 1.

In the present invention, the term "dispensing device" is to be understood particularly as a dispensing head that is or can preferably be mounted on a container or its dispensing valve or on a manually operated pump. In particular, it can also be a pressurized container, a dispenser pump, or the like. The dispensing device is preferably used for delivering or dispensing a product as a spray. However, the dispensing device can also comprise a pump and/or a container.

Through actuation or depression of the dispensing device or of its dispensing head or of an actuating part, a dispensing valve associated with the container is preferably opened and the product to be delivered can come out of or be dispensed through a delivery channel.

The term "product" is to be understood particularly as also including liquids, suspensions and fluids, optionally with gas phases. The product can be delivered as a paste, stream or mist or in another manner, for example as a foam or gel.

In order to deliver a product in different manners, particularly with various spray patterns or spray types, the dispensing device preferably has two delivery channels between which it is possible to switch, as known from U.S. Pat. No. 2,797,965, U.S. Pat. No. 2,997,243, U.S. Pat. No. 3,180,536, U.S. Pat. No. 3,703,994, U.S. Pat. No. 3,863,816, U.S. Pat. No. 5,337,926 and U.S. Pat. No. 5,411,185, for example.

It is the object of the present invention to provide a dispensing device that enables easy switching between delivery channels with a simple and cost-effective construction.

The above object is achieved by a dispensing device as set forth in claim 1. Advantageous developments constitute the subject matter of the subclaims.

One aspect of the present invention is that the dispensing device has an actuating part that engages axially in a switching part or vice versa. This particularly enables separate manufacture of actuating part and switching part as well as very easy assembly. Especially preferably, the actuating part can be particularly placed or snapped axially onto a lower part or housing part of the dispensing device and thus be caused to engage with the switching part.

Another aspect of the present invention that can also be implemented independently is that the switching part has a circumferential seal and/or is embodied so as to be self-sealing. This, again, enables a simple and cost-effective construction. In particular, the switching part is namely introduced axially into an associated receptacle, the switching part being especially preferably embodied as a single piece. This results in very easy assembly with few components.

Especially preferably, the housing part, the actuating part and the switching part form a dispensing head. The dispensing head is then preferably fastened on or to a container of the dispensing device. The dispensing head is especially preferably fluidically connected to a dispensing valve of the dispensing device or of the container, particularly in such a way that, upon actuation or depression of the dispensing head or of the actuating part, the dispensing valve is opened and the product is delivered via the dispensing head—more precisely, via the selected delivery channel.

The actuating part or the dispensing head preferably has a locking position in which both delivery channels are locked or blocked and/or in which an actuation or depression of the actuating part or opening of the associated dispensing valve is locked or blocked.

Especially preferably, when switching between the delivery channels, the respective other delivery channel is blocked by the switching part.

Preferably, the volume of the outlet space in the dispensing head is enlarged after actuation in order to retain the product in the outlet space after closing of the dispensing valve and/or to suction the product (back) into same, or in order to generate a certain negative pressure in the outlet space. In this way, subsequent dripping or foaming of product from the respective delivery channel or outlet space toward the outside can be prevented or at least minimized.

According to one aspect, a relative movement of parts or portions of the outlet space is preferably provided for the enlargement and reduction of the volume of the outlet space—hereinafter also called variation. For example, a connecting part can be coupled with the connection space for this purpose particularly in an axially displaceable manner and spring-biased to the dispensing valve and/or into a position that enlarges the outlet space. This also enables simple manufacturing and/or reliable function.

Additional advantages, features, characteristics and aspects of the present invention follow from the claims and the following description of a preferred embodiment with reference to the drawing.

In the partially not-to-scale, merely schematic figures, the same reference symbols are used for same or similar parts, with corresponding or comparable characteristics and advantages being achieved even if a repeated description is omitted.

FIG. 1 shows a schematic section of a proposed dispensing device 1 for dispensing a product 2, such as a liquid or the like.

Figure 1:
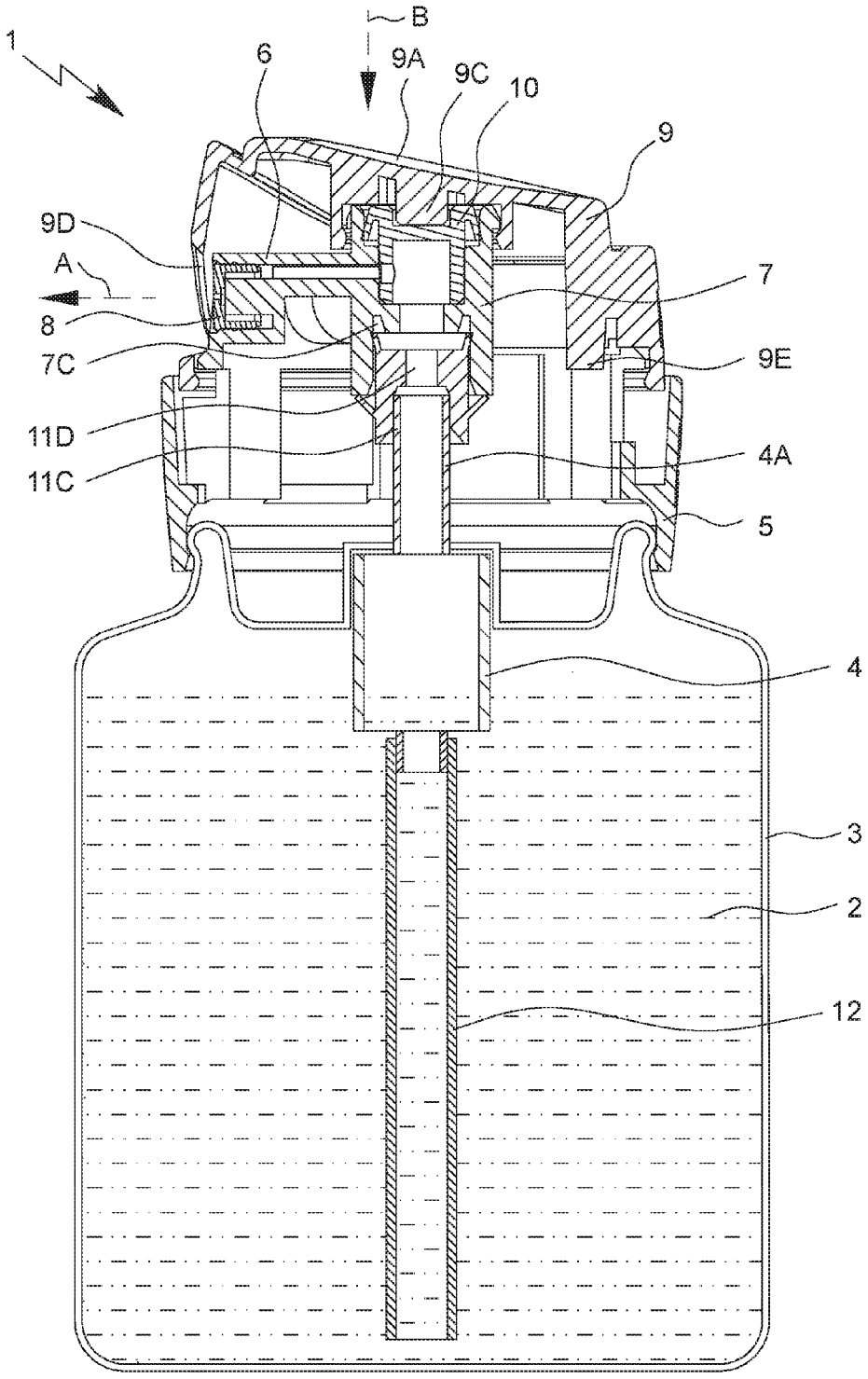
FIG. 1 shows a schematic section of a proposed dispensing device with a container in the non-actuated state.

The product 2 can be more viscous than water or, optionally, even pasty.

In particular, the product 2 can also form a foam or a gel.

The product 2 can also contain gas in liquid and/or another form.

It should be noted that, in principle, any type of dispensing of the product 2—optionally also as a pasty mass, as a gel, as drops, as a stream or as atomized spray—may be involved.

Particularly, the dispensing device 1 is designed to dispense the product 2 in the form of a spray. However, non-spraying delivery is also possible.

Especially preferably, the proposed dispensing device 1 is embodied such that it is possible to switch between different types of delivery of the product 2. This will be discussed later in greater detail.

The dispensing device 1 is preferably provided with or is connected to or can be connected to a reservoir, particularly a container 3, for the product 2 to be delivered. The reservoir can thus form part of the dispensing device 1 or be connected or connectable thereto.

In the depicted example, the reservoir is embodied as a preferably rigid container 3, particularly as a pressurized container. The container 3 for the product 2 or the liquid is particularly embodied in an elongate and/or cylindrical and/or rigid form—especially preferably as a metallic can.

The liquid 2 in the reservoir preferably either is pressurized or can be pressurized. In particular, the container 3 or the liquid 2 contains a suitable propellant, preferably a volatile and/or combustible propellant, compressed gas and/or carbon dioxide. However, the dispensing device 1 can also form a pump or the like that suctions the liquid 2 particularly from the container 3.

The dispensing device 1 or the container 3 preferably has—especially preferably on the front side—a dispensing valve 4 (only indicated schematically) to which the dispensing head preferably formed by the dispensing device 1 is or can be connected. As needed, the dispensing valve 4 can also be a dosing valve or another valve mechanism.

In the depicted example, the dispensing device 1 preferably has a housing part 5 that is or can be connected to the reservoir or container 3, especially preferably placed on same in a clamping and/or locking manner.

Figure 3:
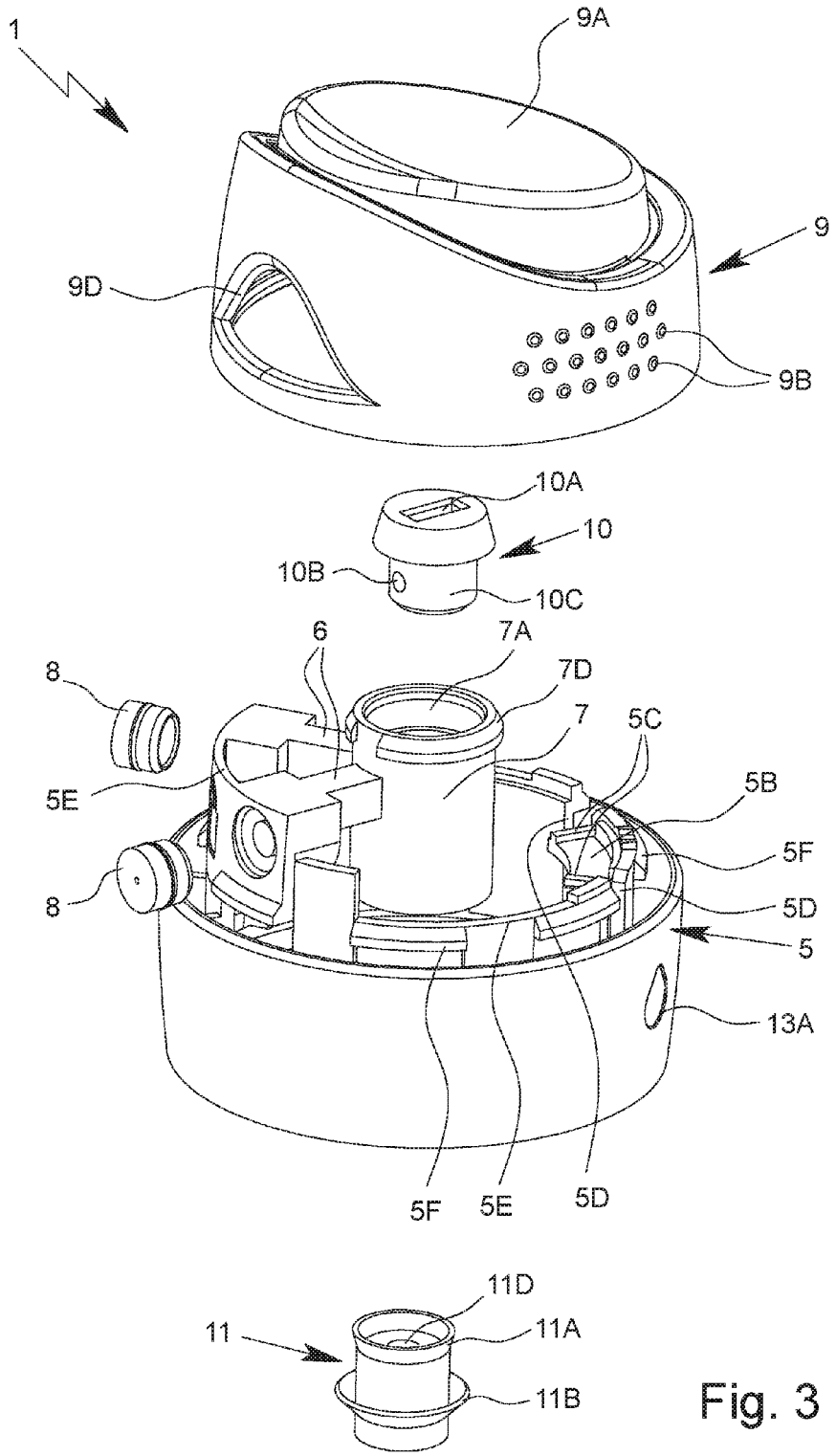
FIG. 3 shows a perspective, exploded view of the dispensing device without container.
Figure 4:
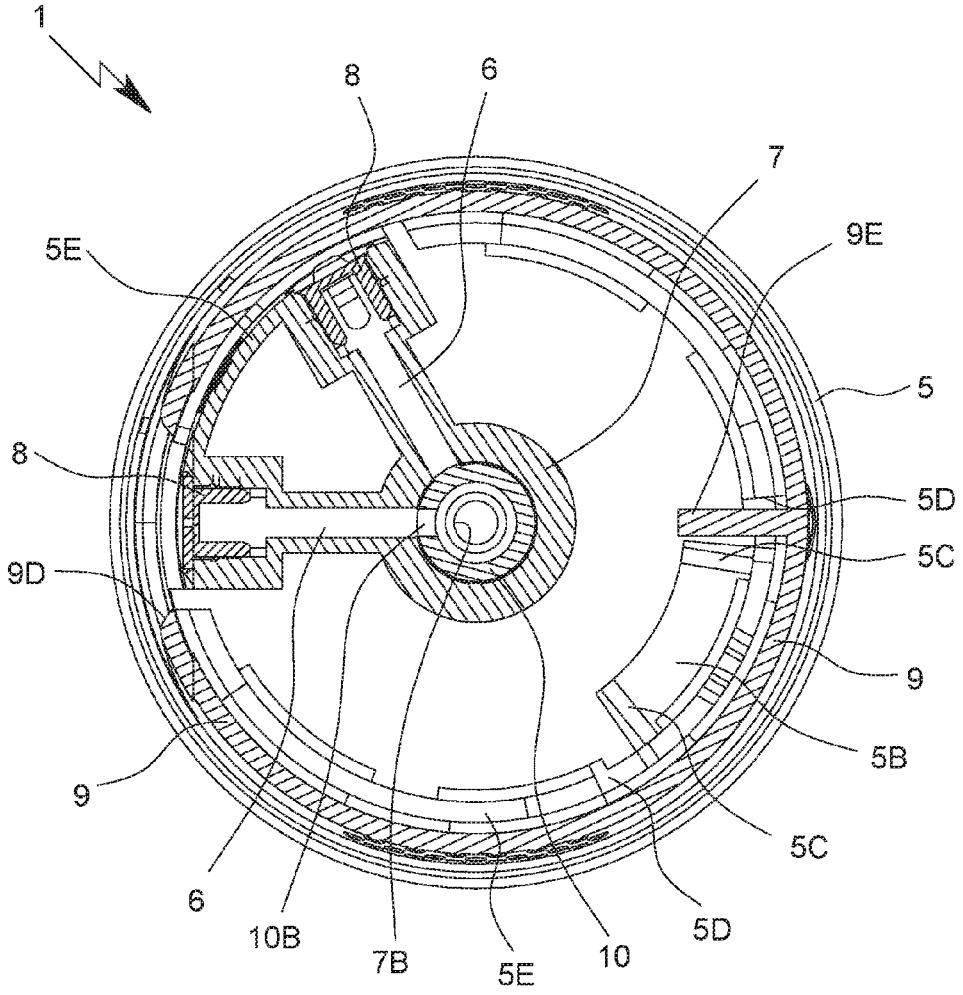
FIG. 4 shows a schematic horizontal section of the dispensing device.

The dispensing device 1 or the housing part 5 preferably has two delivery channels 6 for optional delivery of the product 5. In the schematic section according to FIG. 1, only one delivery channel 6 can be seen. The same applies to the enlarged sectional representation according to FIG. 2, which shows the dispensing device 1 in a corresponding, enlarged section without container 3. In contrast, the perspective, exploded representation according to FIG. 3 and the horizontal section according to FIG. 4 show both delivery channels 6.

The dispensing device 1 or the housing part 5 preferably has a receptacle 7, which is particularly arranged centrally and/or on the inside or in the middle.

The delivery channels 6 are fluidically adjoined to the receptacle 7.

The delivery channels 6 preferably extend from the receptacle 7 radially outward and/or in different directions (delivery direction A).

The delivery channels 6 preferably extend at least substantially straight away from the receptacle 7.

The delivery channels 6 end on the outlet side preferably in the region of a periphery or ring-shaped area of the dispensing device 1 or of the housing part 5.

On the outlet side, the delivery channels 6 each preferably form a delivery opening or an outlet and/or are each embodied so as to receive a nozzle insert 8.

Preferably, the receptacle 7 is held—preferably exclusively—by the delivery channels 6.

Especially preferably, the receptacle 7 is held in a spring-biased manner by the delivery channels 6 such that the receptacle 7 can be depressed or tilted downward upon actuation of the dispensing device 1, particularly such that the delivery channels 6 can be tilted downward together with the receptacle 7. Accordingly, the angle between the two delivery channels 6 is preferably less than 90°, particularly and preferably substantially between 30 and 60°.

Especially preferably, the housing part 5, the delivery channels 6 and the receptacle 7 are integrally formed.

To enable the depression or downward tilting, that is, a downward tipping, the delivery channels 6 are preferably connected to the housing part 5 in a spring-biased manner or held by same. However, other structural solutions are also possible in principle.

In the normal operating position, the delivery channels 6 preferably extend at least substantially horizontally. The actuation or depression preferably occurs transverse to this, particularly downward or at least substantially vertically.

The dispensing device 1 or its dispensing head preferably has an actuating part 9 and an associated switching part 10.

The actuating part 9 and the switching part 10 are preferably separate parts. In principle, however, they can also be embodied as a single piece as needed.

The actuating part 9 is preferably embodied in the manner of a cap and/or placed or snapped onto the housing part 5 or the dispensing head.

The actuating part 9 is preferably held or supported on the housing part 5 so as to be manually rotatable. The rotation is preferably done manually by a user (not shown) and/or about an axis that is vertical in the operating position.

The actuating part 9 can preferably be depressed manually by a user (not shown). The actuating part 9 preferably has an upper or front-side actuation surface 9A for this purpose.

The actuating part 9 preferably has actuation elements 9B on its circumferential side such as ribbing, projections, or the like in order to facilitate the manual rotation of the actuating part 9.

The actuating part 9 is preferably integrally formed.

The switching part 10 is preferably inserted into the receptacle 7—preferably axially.

The switching part 10 can preferably be rotated by means of the actuating part 9 or by the actuating part 9 in order to switch between and/or to block the delivery channels 6.

The switching part 10 and the actuating part 9 are preferably coupled with one another in a rotationally fixed manner, particularly through axial engagement.

Preferably, the actuating part 9 engages axially in the switching part 10 or vice versa.

Figure 2:
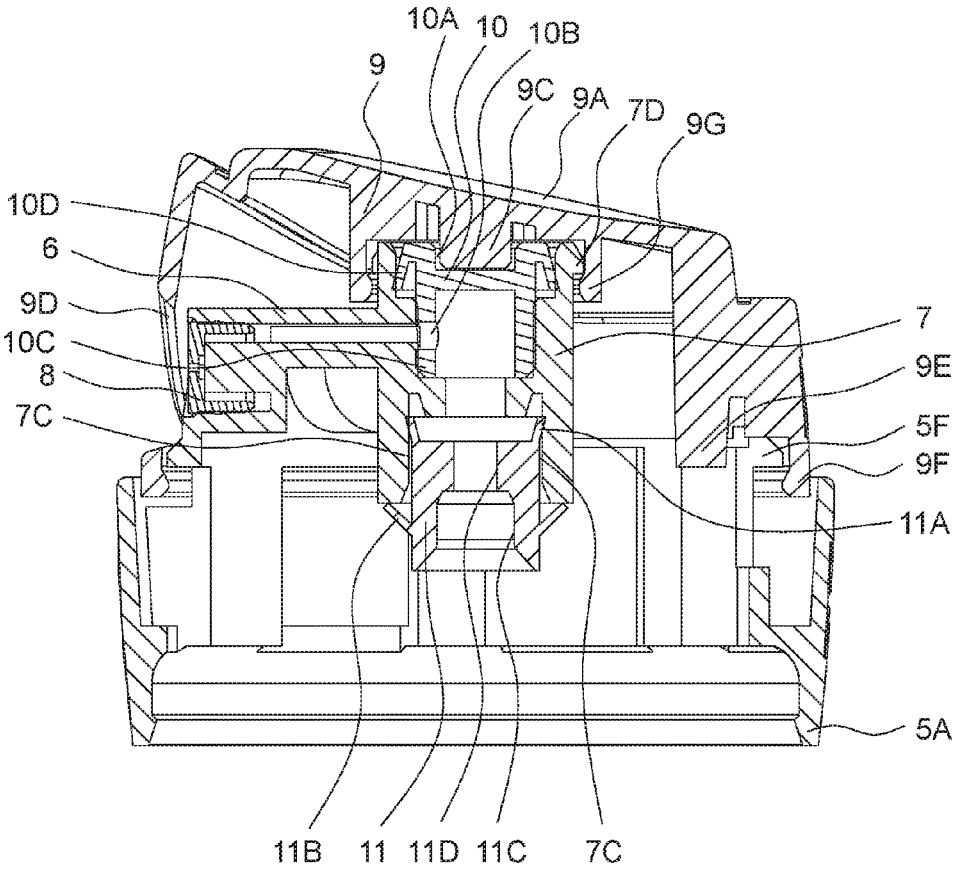
FIG. 2 shows a schematic longitudinal section of the dispensing device without container.

In the depicted example, the actuating part 9 preferably has a projection 9C that projects axially downward and/or toward the receptacle 7 or toward the switching part 10 and/or is embodied as a bar and/or engages in a corresponding front-side recess 10A of the switching part 10, as indicated in FIGS. 1 and 2. However, other structural solutions are also possible here.

The dispensing device 1 or the dispensing head or receptacle 7 is or can be connected fluidically to the container 3 or the dispensing valve 4, as particularly indicated in FIG. 1. Especially preferably, there is a fluid connection to or via a valve element 4A of the dispensing valve 4. The valve element 4A is particularly tubular or nozzle-like and/or can be tipped or depressed in order to actuate or open the dispensing valve 4.

The dispensing valve 4 preferably closes automatically. Particularly, the valve element 4A is spring-loaded into its closed initial position.

In the depicted example, the dispensing head or the housing part 5 or the receptacle 7 is preferably fluidically connected to the dispensing valve 4 or its valve element 4A via an optional connecting part 11.

Preferably, the connecting part 11 is arranged on the inlet side on the dispensing head or on the receptacle 7, especially preferably in an axially displaceable manner.

Especially preferably, the connecting part 11 is placed onto the dispensing valve 4 or its valve element 4A or vice versa.

Preferably, the receptacle 7 has an at least substantially cylindrical outer contour.

Preferably, the receptacle 7 has a preferably at least substantially hollow and cylindrical receiving area 7A for the switching part 10.

The receiving area 7A is preferably open toward the actuating part 9 or in the upward direction, so that the switching part 10 can be correspondingly inserted or plugged in axially.

The switching part 10 is preferably received rotatably in the receptacle 7 or in the receiving area 7A.

The dispensing channels 6 adjoin the receiving area 7A, particularly radially.

The receptacle 7 preferably has a connection channel 7B starting from the receiving area 7A in the axial direction for fluidically connecting the container 3 and/or dispensing valve 4.

The connection channel 7B or the receptacle 7 has on the inlet side a preferably radially expanded connection area 7C into which the dispensing valve 4 or its valve element 4A engages—especially preferably together with the optional connecting part 11.

In particular, the connecting part 11 is at least partially inserted or plugged into the connection area 7C or received by same.

Especially preferably, the housing part 5, optionally the nozzle inserts 8, the actuating part 9, the switching part 10 and optionally the connecting part 11 form the dispensing head, which can be connected to the container 3 or another reservoir.

FIG. 1 shows the dispensing device 1 in the non-actuated state. The dispensing head is fastened to the container 3; particularly, the housing part 5 is fastened to, especially preferably snapped onto, a connection area 5A on an edge of the container 3.

In the depicted state, the actuating part 9 and thus also the switching part 10, that is connected to it in a rotationally fixed manner, are rotated such that a delivery channel 6 is unblocked.

Preferably, the actuating part 9 has a delivery opening 9D that is then correspondingly rotated in front of the unblocked delivery channel 6 or its outlet. In the depicted example, the delivery opening 9D is preferably embodied in the manner of a mouth, as can be seen particularly in FIGS. 3 and 5. However, other structures are also possible here.

Figure 5:
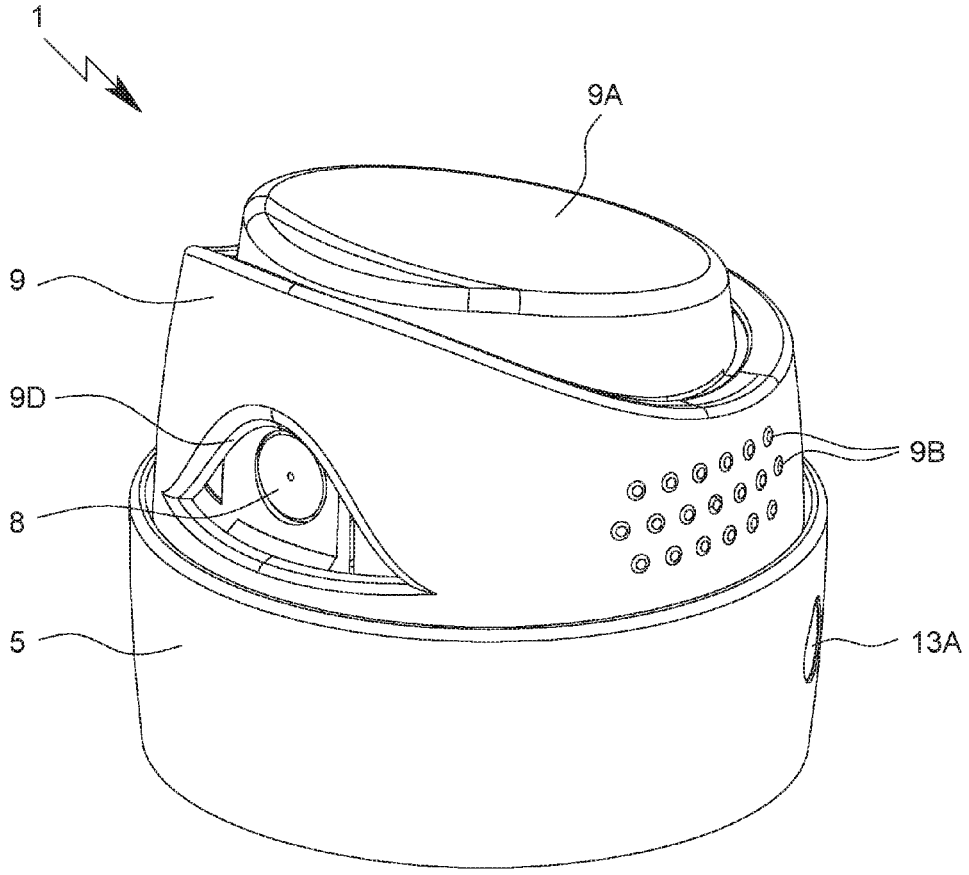
FIG. 5 shows a perspective view of the dispensing device without container on the delivery side.

FIG. 5 shows a perspective view of the dispensing device 1 and the dispensing head without container 3 in the region of the dispensing side, here in the unblocked state with an opened outlet. The switching part 10 preferably has a particularly radial through hole 10B in order to fluidically couple or unblock a respective delivery channel 6 as a function of the rotational position, that is, in order to establish a fluidic connection from connection area 7C or connection channel 7B via or through the switching part 10 to the respective delivery channel 6.

The horizontal section according to FIG. 4 illustrates such a situation. Here, the delivery channel 6 pointing toward the left is fluidically connected or unblocked. The other delivery channel 6 pointing toward the upper left, on the other hand, is blocked by the switching part 7 or its peripheral wall. This wall can thus also be understood as a blocking portion 10C.

Preferably, the switching part 10 can also attain a blocking position or intermediate position in which both delivery channels 6 are blocked simultaneously. In this state, the dispensing head or the dispensing device 1 or the actuating part 9 is preferably locked or blocked against actuation or depression.

As mentioned previously, the switching part 10 is rotated through appropriate rotation of the actuating part 9 in order to switch between the delivery channels 6 or to (simultaneously) lock the delivery channels 6 in the locked or intermediate position.

Figure 6:
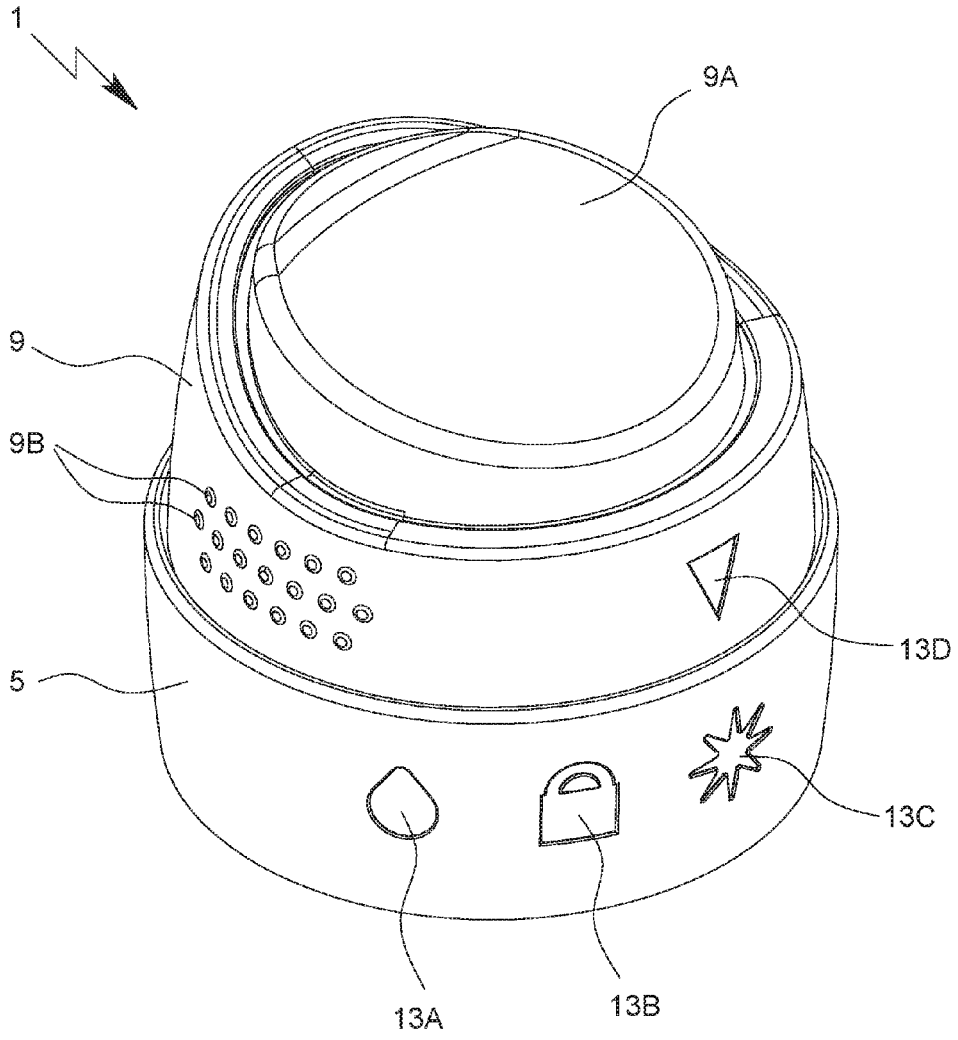
FIG. 6 shows a perspective view of the dispensing device without container from the rear side.

Especially preferably through the use of different nozzle inserts 8, the two delivery channels 6 preferably have different dispensing behaviors or spraying behaviors. For example, a more spraying or mist-like delivery of the product 2 can occur via one delivery channel 6, whereas a more stream-like or drop-like delivery occurs with the other delivery channel 6. The different delivery types or the different dispensing behaviors can be particularly made apparent to the user by corresponding symbols 13A and 13C, as indicated in the perspective rear view according to FIG. 6. Moreover, a symbol 13B then indicates the intermediate or blocking position, for example. In the depicted example, the arrow 13D, or another symbol on the actuation element 9, preferably refers to the respective symbol 13A, 13B, 13C on the outer periphery of the dispensing head or housing part 5 as a function of the rotational position of the actuating part 9 and thus as a function of the rotational position of the switching part 10. However, other structural solutions for displaying the respective state are also possible here.

The opening 9D of the actuating part 9 is moved as a function of the rotational position in front of the outlet of the respectively unblocked delivery channel 9. In this way, the user thus also recognizes alternatively or in addition when the dispensing device 1 or the dispensing head or the actuating part 9 is in an unblocked position and can be used directly through depression.

Alternatively or in addition, the intermediate or blocking position can also be recognized by the user through the fact that no nozzle or outlet is located behind the opening 9D, but rather a continuous or plain area or an area provided with a blocking symbol, for example, particularly of the housing part 5.

The actuating part 9 preferably forms a rigid cap of the dispensing head or of the dispensing device 1.

In the illustrated unblocked state, upon actuation of the dispensing device 1 or of the actuating part 9 in the direction of actuation B indicated in FIG. 1—that is, upon depression thereof—the receptacle 7 is tipped or moved resiliently downward or toward the container 3. As a result, the dispensing valve 4 is opened, here through depression of the valve element 4A, particularly via the optional connecting part 11. The pressurized product 2 can flow via the riser tube 12, which is preferably connected to the dispensing valve 4, through the dispensing valve 4 or valve element 4A into the dispensing head. There, the product 2 is conducted through or via the optional connecting part 11 into the receptacle 7 or, more precisely, through the outlet channel 7B and through the switching part 10 or its through hole 10B into the unblocked delivery channel 6 and, from there, dispensed particularly via the respective nozzle insert 8 in a desired manner through the opening 9D in the actuating part 9 in the delivery direction A, as illustrated schematically in FIG. 1. In this context, it should be noted that FIG. 1 shows the dispensing device 1 when it is not in the actuated state.

Upon completion of actuation, that is, after the actuating part 9 has been released, the delivery channels 6 spring back with the receptacle 7 upward into the initial position. The actuating part 9 is moved back or lifted into the non-actuated position. Accordingly, the dispensing valve 4 can close again automatically. The dispensing of the product is completed.

The dispensing device 1 or the actuating part 9 preferably has a blocking element 9E that blocks against depression, that is, actuation, in the intermediate or blocking position. As indicated in FIGS. 3 and 4, in the blocking position of the actuating part 9 the blocking element 9E is blocked against depression or movement in the direction of motion B by a stop 5B on the housing part 5.

The blocking element 9 is preferably arranged on the side opposite to the opening 9D.

The stop 5B is preferably arranged on the inside of the housing part 5 and/or integrally formed on the housing part 5 or formed by same.

The stop 5B is preferably arranged on the housing part 5 on the side opposite to the delivery channels 6.

The stop 5B is preferably embodied as an axial run-up surface and/or annular portion extending in the circumferential direction.

The blocking element 9E is preferably embodied rib-like and/or as an axially and/or radially inwardly projecting stop edge.

Especially preferably, the actuating part 9 can be moved or rotated only by overcoming a resistance during rotation from the intermediate or blocking position into one of the two unblocking positions for delivery via the respective delivery channel 6. In the depicted example, a respective corresponding rib 5C is preferably formed for this purpose that must be appropriately passed over or overcome by the blocking element 9E in order to reach the respective adjacent unblocking position.

The two ribs 5C are preferably each arranged in the region of the two ends of the stop 5B on the peripheral side. However, other structural solutions are also possible.

In the unblocked position or unblocking position, the actuating part 9 can be depressed in the direction of actuation B. In particular, this is made possible by virtue of the fact that, in this position, the blocking element 9E does not run up or abut against the stop 5B, but rather can dip into a corresponding recess 5D in the housing part 5.

Especially preferably, the housing part 5D has a particularly interior ring-shaped area 5E that bears or forms the stop 5B, for example, and/or is appropriately recessed in order to form the recesses 5D.

Preferably, the ring-shaped area 5E bears the delivery channels 6 on the delivery side and/or extends therebetween, especially preferably in order to cover the opening 9D of the actuating part 9 in the intermediate position on the rear side.

Especially preferably, the actuating part 9 can be connected in a locking manner to the housing part 5 and/or the receptacle 7. For example, corresponding detent lugs or latching projections 5F are formed for this purpose in the housing part 5D or on the ring-shaped area 5E and/or a collar 7D is formed at the receptacle 7 in order to enable or ensure the desired latching engagement with the actuating part 9 and/or a form-fitting securement of the actuating part 9 against being pulled or lifted off axially.

In the depicted example, the actuating part 9 has inwardly projecting projections 9F and 9G, for example, that engage around or behind the latching projections 5F or the collar 7D. However, other structural solutions are also possible.

Figure 7:
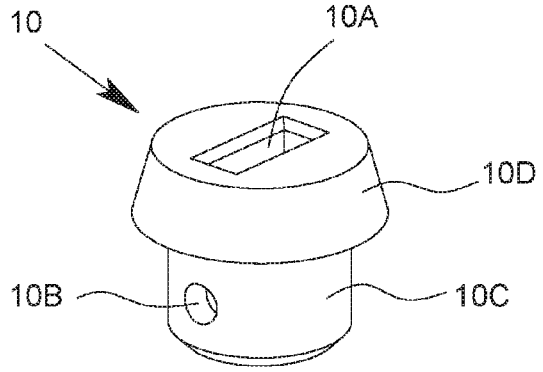
FIG. 7 shows a perspective view of a switching part of the dispensing device.

FIG. 7 shows a perspective view of the switching part 10 according to the depicted design variant. Here, the switching part 10 is embodied at least substantially as a downwardly open sleeve that has the particularly hole-like through hole 10B in the cylindrical wall. The sleeve or the switching part 10 is axially open in the downward direction, that is, toward the connection channel 7B, whereby product 2 entering axially via the through hole 10B into the respectively connected or unblocked delivery channel 6 can flow out or continue to flow.

At the upper end, that is, at the end facing toward the actuating part 9, the switching part 10 is closed, and the switching part 10 has the possibility for engagement, here preferably in the form of the recess 10A, in order to enable rotationally fixed coupling or rotation of the switching part 10.

The switching part 10 preferably has a seal 10D that is particularly arranged in the area of the upper end and/or circumferentially embodied.

In particular, the seal 10D forms a radial seal and/or a seal between the receptacle 7 and the switching part 10, particularly so that pressurized product 2 cannot emerge axially from the receptacle 7 in the direction of the actuating part 9.

The seal 10D is preferably embodied as a circumferential lip and/or flexible lip.

The seal 10D is preferably integrally formed.

The seal 10D is preferably embodied so as to be self-sealing, particularly in such a way that, in the presence of product pressure it spreads automatically outward and abuts against the cylindrical inner wall of the receiving area 7A of the receptacle 7.

The through hole 10B of the switching part 10 is preferably arranged axially beneath the seal 10D.

Figure 8:
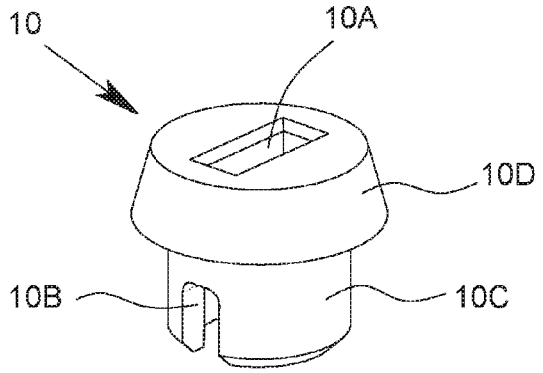
FIG. 8 shows a perspective view of the switching part according to another embodiment.

FIG. 8 shows the switching part 10 according to another embodiment in a perspective view corresponding to FIG. 7. Here, the through hole 10B is embodied not in the manner of a bore hole, but in the manner of a slot, particularly an axial slot, that is especially preferably open toward the lower end of the switching part 10.

Figure 9:
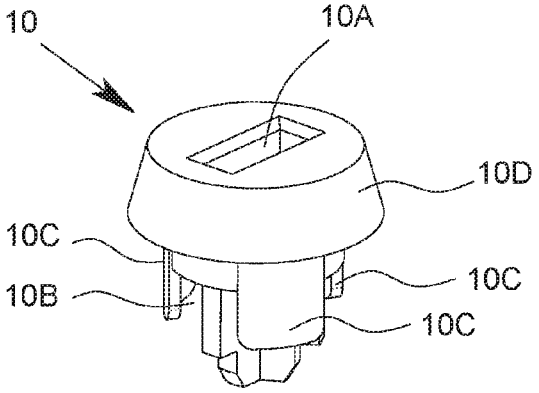
FIG. 9 shows a perspective view of the switching part according to yet another embodiment.

FIG. 9 shows the switching part 10 according to another embodiment in a perspective view corresponding to FIGS. 7 and 8. Here, the peripheral wall is formed by preferably tab-like blocking portions 10C that extend axially downward starting from the upper ring-shaped area and cover the inlet openings of the delivery channels 6 as a function of the rotational position of the switching part 10.

The preferably tab-like design of the blocking portion 10C of the switching part 10 supports the automatic sealing of a blocked delivery channel 6 in that the existing product pressure presses the blocking portion 10C radially outward against the inlet of the respective delivery channel 6 to be sealed and thus into the sealing position.

The dispensing head or the receptacle 7 preferably forms an outlet space for the product 2 to be dispensed. The outlet space is preferably initially reduced in volume upon actuation of the actuating part 9 prior to opening of the dispensing valve 4 and later enlarged again in terms of volume upon completion of actuation, particularly after the closing of the dispensing valve 4. Through the variation in volume, it can be achieved that product 2 located in the outlet space, that is, particularly in the receptacle 7 and in the connected delivery channel 6, is retained therein upon completion of dispensing and, in particular, does not emerge subsequently in an undesired manner from the outlet of the connected delivery channel 6. This variation in volume is preferably achieved here through the appropriate axial movement of the optional connecting part 11 relative to the receptacle 7 or in the connection area 7C in the depicted example.

Figure 10:
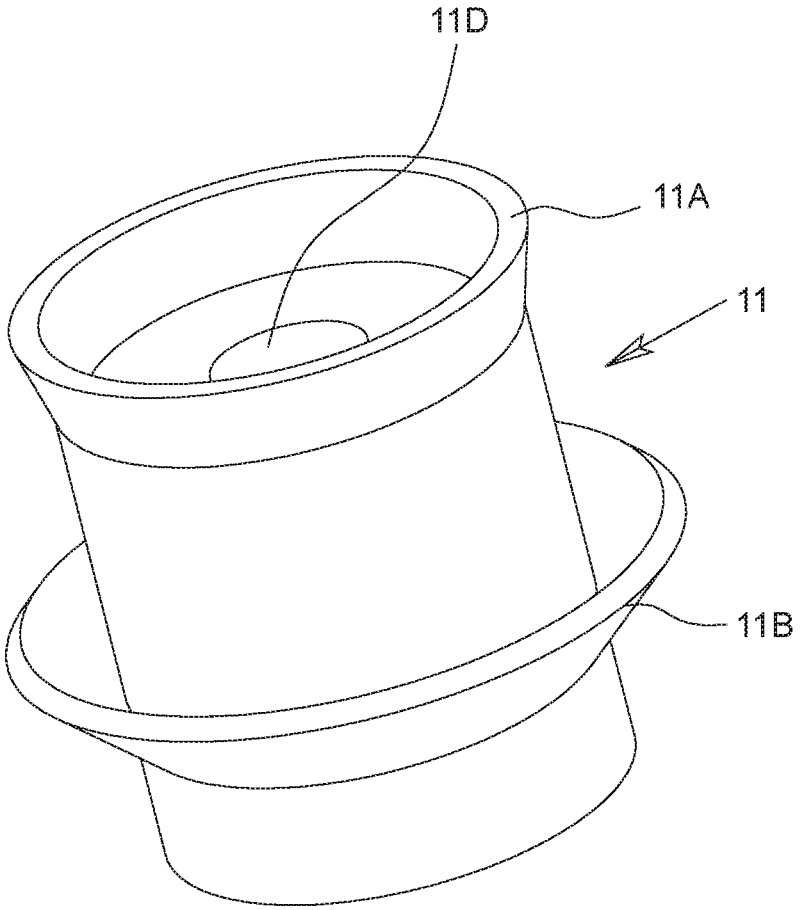
FIG. 10 shows a perspective view of a connecting part of the dispensing device.

FIG. 10 shows a perspective view of the connecting part 11 according to the preferred design variant. The connecting part 11 has a seal 11A for radially sealing the connecting part 11 in the receptacle 7 or in the connection area 7C.

More preferably, the connecting part 11 has a spring section 11B that resiliently biases the connecting part 11 into the axially displaced position illustrated in FIGS. 1 and 2. This initial tension is preferably such that, upon actuation of the dispensing head or of the actuating part 9—that is, upon depression of the receptacle 7—the connecting part 11 is first pressed axially (further) into the connection area 7C under deformation of the spring section 11B before the dispensing valve 4 is opened for the dispensing of the product through depression of the valve element 4A.

After actuation, the dispensing valve 4 first closes, and the connecting part 11 then moves again axially somewhat out of the receptacle 7 due to the restoring force of the spring section 11B, whereby the desired increase in the volume of the outlet space is achieved in order to prevent product 2 located in the receptacle 7 and in the adjacent delivery channel 6 from coming out in an undesired manner.

The proposed embodiment enables a very simple construction composed of few components and easy assembly. In particular, only the axial insertion of the nozzle inserts 8, of the switching part 10, and/or of the connecting part 11 is necessary. Furthermore, given the appropriate rotational alignment, the actuating part 9 can simply be placed and snapped axially onto the housing part 5 with inserted switching part 10. The assembly or pre-assembly of the dispensing head is as simple as that.

The housing part 5 is preferably injection-molded from a suitable plastic.

The same preferably applies to the actuating part 9.

The switching part 10 is preferably made of a relatively soft plastic, particularly of a plastic that is softer than the plastic of the housing part 5 or of the receptacle 7.

LIST OF REFERENCE SYMBOLS

1 dispensing device
2 product
3 container
4 dispensing valve
5 housing part
5A connection area
5B stop
5C rib
5D recess
5E ring-shaped area
5F latching projection
6 delivery channel
7 receptacle
7A receiving area
7B connection channel
7C connection area
7D collar
8 nozzle insert
9 actuating part
9A actuation surface
9B actuation element
9C projection
9D opening
9E projection
9F projection
10 switching part
10A recess
10B through hole
10C blocking portion
10D seal
11 connecting part
11A seal
11B spring section
11C connection area
11D passage
12 riser tube
13 symbol
13A symbol
13B symbol
13C symbol
13D symbol
A delivery direction
B direction of actuation

The invention claimed is:

1. Dispensing device for a liquid product,
with a housing part, an actuating part and a switching part,
wherein the housing part has two delivery channels and the switching part can be rotated by means of the actuating part for switching between the delivery channels and/or for blocking the delivery channels,
wherein:
the actuating part engages axially in the switching part or vice versa,
wherein the switching part has an at least substantially cylindrical outer contour,
wherein the switching part is closed at the end facing toward the actuating part, and
wherein the switching part is adapted for engagement in order to enable rotationally fixed coupling of the switching part.

2. Dispensing device according to claim 1, wherein the dispensing device or the housing part has a central receptacle for the switching part.

3. Dispensing device according to claim 2, wherein the delivery channels adjoin the receptacle and extend from same in different directions and/or radially.

4. Dispensing device according to claim 2, wherein the receptacle is at least substantially hollow and cylindrical and/or the switching part is inserted axially therein.

5. Dispensing device according to claim 2, wherein the receptacle is held only and/or in a depressible manner by the delivery channels.

6. Dispensing device according to claim 1, wherein the dispensing device or the housing part has a connection area for an associated dispensing valve.

7. Dispensing device according to claim 2, wherein the receptacle or an associated connecting part forms a connection area for an associated dispensing valve.

8. Dispensing device according to claim 1, wherein the dispensing device has a container with or for the product, wherein the housing part is fastened to the container and/or the switching part is fluidically connected to a dispensing valve of the container.

9. Dispensing device according to claim 1, wherein the housing part forms a dispensing head, together with the actuating part and the switching part.

10. Dispensing device according to claim 1, wherein the seal has or is a lip that is flexible and/or can be spread radially outward.

11. Dispensing device according to claim 1, wherein the switching part is pressed by the existing product pressure in a sealing manner against a blocked delivery channel.

12. Dispensing device according to claim 1, wherein the actuating part is a one-piece construction or a unitary element.

13. Dispensing device according to claim 1, wherein the actuating part covers the complete upper face of the housing part.

14. Dispensing device according to claim 1, wherein the actuating part is snapped onto the housing part and, thus, axially engaging the switching part so that the actuating part and switching part are rotatably coupled.

15. Dispensing device according to claim 1, wherein the switching part and the actuation part are two separate parts.

16. A dispensing device for a liquid product comprising:

a housing part, an actuating part and a switching part, wherein the housing part has two delivery channels and the switching part can be rotated by the actuating part for switching between the delivery channels and/or for blocking the delivery channels, wherein the actuating part engages axially in the switching part or vice versa, wherein the switching part has an at least substantially cylindrical outer contour, wherein the switching part has a circumferential seal, wherein the seal is self-sealing, and wherein the seal has or is a lip that is flexible and can be spread radially outward.

17. The dispensing device according to claim 16, wherein the dispensing device or the housing part has a central receptacle for the switching part.

18. The dispensing device according to claim 17, wherein the delivery channels adjoin the receptacle and extend from same in different directions and/or radially.

19. The dispensing device according to claim 17, wherein the receptacle is at least substantially hollow and cylindrical and/or the switching part is inserted axially therein.

20. The dispensing device according to claim 17, wherein the receptacle is held only and/or in a depressible manner by the delivery channels.

21. The dispensing device according to claim 16, wherein the dispensing device or the housing part has a connection area for an associated dispensing valve.

22. The dispensing device according to claim 17, wherein the receptacle or an associated connecting part forms a connection area for an associated dispensing valve.

23. The dispensing device according to claim 16, wherein the dispensing device has a container with or for the product, wherein the housing part is fastened to the container and/or the switching part is fluidically connected to a dispensing valve of the container.

24. The dispensing device according to claim 16, wherein the housing part forms a dispensing head, together with the actuating part and the switching part.

25. The dispensing device according to claim 16, wherein the switching part is pressed by existing product pressure in a sealing manner against a blocked delivery channel.

26. The dispensing device according to claim 16, wherein the actuating part is a one-piece construction or a unitary element.

27. The dispensing device according to claim 16, wherein the actuating part covers the complete upper face of the housing part.

28. The dispensing device according to claim 16, wherein the actuating part is snapped onto the housing part and, thus, axially engaging the switching part so that the actuating part and switching part are rotatably coupled.

29. The dispensing device according to claim 16, wherein the switching part and the actuation part are two separate parts.

30. The dispensing device according to claim 16, wherein the switching part is closed at the end facing toward the actuating part, and wherein the switching part has the possibility for engagement in order to enable rotationally fixed coupling of the switching part.

* * * * *